US007828162B2

(12) United States Patent
Wiesbauer

(10) Patent No.: US 7,828,162 B2
(45) Date of Patent: Nov. 9, 2010

(54) VEHICLE MOUNTED CRANE

(75) Inventor: Thomas Wiesbauer, Bietigheim-Bissingen (DE)

(73) Assignee: Manitowoc Crane Group Germany GmbH, Wilhelmshaven (DE)

( * ) Notice: Subject to any disclaimer, the term of this patent is extended or adjusted under 35 U.S.C. 154(b) by 6 days.

(21) Appl. No.: 11/792,062

(22) PCT Filed: Dec. 1, 2005

(86) PCT No.: PCT/EP2005/012852

§ 371 (c)(1),
(2), (4) Date: Jan. 8, 2008

(87) PCT Pub. No.: WO2006/058751

PCT Pub. Date: Jun. 8, 2006

(65) Prior Publication Data

US 2008/0169258 A1 Jul. 17, 2008

(30) Foreign Application Priority Data

Dec. 3, 2004 (EP) ..... 04028739

(51) Int. Cl.
*B66B 23/42* (2006.01)

(52) U.S. Cl. ..... 212/297; 212/238; 212/261

(58) Field of Classification Search ..... 212/297, 212/238, 261
See application file for complete search history.

(56) References Cited

U.S. PATENT DOCUMENTS

| | | | | | |
|---|---|---|---|---|---|
| 2,143,111 | A | * | 1/1939 | Hayes | 414/560 |
| 2,544,553 | A | * | 3/1951 | Eakin | 212/295 |
| 2,639,825 | A | * | 5/1953 | Eakin | 414/546 |
| 3,856,150 | A | | 12/1974 | Wellman et al. | |
| 3,938,670 | A | * | 2/1976 | Wellman | 212/296 |
| 4,625,475 | A | * | 12/1986 | McGinnis | 52/108 |
| 4,846,357 | A | * | 7/1989 | Sholl et al. | 212/307 |
| 4,944,364 | A | * | 7/1990 | Blasko | 182/2.9 |
| 5,025,606 | A | * | 6/1991 | McGinnis et al. | 52/745.17 |
| 6,405,492 | B1 | * | 6/2002 | Scheid et al. | 52/114 |
| 6,550,624 | B1 | * | 4/2003 | Irsh et al. | 212/299 |
| 7,204,378 | B2 | * | 4/2007 | Schaeff | 212/291 |
| 2005/0150854 | A1 | * | 7/2005 | Toudou et al. | 212/175 |
| 2007/0056801 | A1 | * | 3/2007 | Iversen | 182/141 |

FOREIGN PATENT DOCUMENTS

| | | | | |
|---|---|---|---|---|
| DE | 3150282 | | * | 6/1983 |
| DE | 3307892 | A1 | | 9/1984 |
| DE | 3441655 | A1 | | 5/1986 |
| DE | 197 31 049 | A1 | * | 2/1999 |
| FR | 2499050 | | | 1/1982 |
| GB | 1227659 | | | 4/1969 |
| JP | 1978-055857 | | | 5/1978 |
| JP | 7-223798 | A | * | 8/1995 |
| JP | 2004-224520 | A | | 12/2004 |
| SU | 1118601 | | * | 10/1984 |

* cited by examiner

*Primary Examiner*—Thomas J. Brahan
(74) *Attorney, Agent, or Firm*—Birch, Stewart, Kolasch & Birch, LLP

(57) ABSTRACT

The invention relates to a vehicle crane, especially a mobile crane, automobile crane, or track-laying crane, comprising a superstructure which is embodied as a top slewing crane and encompasses a vertical tower and a boom located on the tower.

17 Claims, 13 Drawing Sheets

VEHICLE MOUNTED CRANE

The invention relates to a vehicle mounted crane, in particular a mobile, self-propelled or crawler crane.

In crane technology, a distinction is commonly made between categories on the basis of tower slewing cranes or tower cranes, on the one hand, and vehicle mounted cranes, on the other hand.

Tower slewing cranes have a vertical tower standing on a sub-structure, which is usually provided in the form of a lattice framework. Although they can be moved by means of a track system, on building sites for example, they are not designed to operate as vehicles which can move in normal road traffic. Vehicle mounted cranes, on the other hand, are self-driving road vehicles and are designed precisely for mobile applications.

Vehicle mounted cranes comprise an undercarriage incorporating the bogie and a top carriage which is able to rotate on the undercarriage and comprises a slewing unit and a jib. The jib may be a telescopic jib based on a box-type design or a lattice mast boom.

Increasingly tougher demands are being placed on cranes both in terms of carrying strength and lifting capacity as well as the height to which the loads have to be lifted.

One application in which cranes are becoming increasingly important is that of erecting wind turbines. There is a growing trend towards higher performance wind turbines, which not only requires higher lifts but also lifting of heavier components.

Amongst the problems of erecting wind turbines by means of existing cranes is the practically unavoidable damage to the ground, incurring high costs. This results from the immense total weight of the crane, and the fact that a number of individual trips have to be made carrying heavy loads to the site of wind turbines, which are usually in remote locations.

The objective of the invention is to propose a vehicle mounted crane that is suitable for erecting wind turbines. To this end, the present invention provides a crane which is of as low a weight as possible and can be made ready for operation as quickly as possible in order to reduce the cost of using a crane to a minimum, but without reducing the carrying power or lifting capacity. This objective is achieved by providing a vehicle mounted crane having a structure in the form of a top-slewing system comprising a vertical tower and a jib on the tower. The concept proposed by the invention, based on a top-slewing structure with a vertical tower and a jib fitted on it, constitutes a departure from conventional vehicle mounted cranes. In conventional vehicle mounted cranes the slewing system is disposed on a level with the bogie and the mast, which is usually telescopic or in the form of a lattice frame, is inclined with respect to the vertical. Such a crane is often provided with a counter-weight which rotates with it in order to achieve the necessary stability and prevent overturning in a range of operating positions. This is referred to as the crane radius. The vehicle mounted crane of the invention improves upon this arrangement due to the vertical tower.

Surprisingly, it has been found that the concept proposed by the invention, based on a non-rotating vertical tower, offers a number of advantages. In particular, because there is no crane radius and because no counter-measures in the form of heavy counter-weights are needed, a crane with a relatively low overall weight (as compared to its carrying strength or lifting capacity) can be obtained. This has a positive effect on mobility and reduces damage to the terrain because only a relatively small number of individual trips are needed. A vehicle mounted crane with a top-slewing system as proposed by the invention also opens the way for advantageous options for additionally securing or stabilising the tower if necessary and also provides a particularly simple concept for erecting the tower. This will be explained in more detail below.

The jib of the invention is preferably inclined with respect to the tower. In saying that the jib is "inclined" with respect to the tower, it should be understood as including a horizontal extension, i.e. wherein the jib extends perpendicular to the tower.

In accordance with the invention, the jib is also preferably such that its length can be adjusted and/or its angle relative to the tower can be adjusted. To enable a length adjustment, the jib is preferably of a telescopic design.

In one embodiment, the jib is an integral part of a component unit which can be transported as a whole and, in addition to the jib, comprises a slewing unit, a luffing system, a block and pulley with a bottom block and top roller pulley and, optionally, a crane driver's cab, as well as all of the drive units needed for this equipment. To this extent, this component unit incorporating the jib may be termed a top carriage, although the term "top carriage" as used in connection with conventional vehicle mounted cranes refers to the entire structure fitted directly on the bogie, also referred to as the undercarriage.

In accordance with the invention the tower may also be of an adjustable length. The tower may be provided in the form of a telescopic tower.

In accordance with another feature of the invention, the intrinsic weight of the tower may serve as a counter-weight. Unlike conventional vehicle mounted cranes in which the mast is always inclined at an angle due to the crane radius, and a counter-weight has to be provided which significantly increases the overall weight of the crane, such an additional counter-weight can be dispensed with in the case of the vehicle mounted crane proposed by the invention while maintaining a high carrying strength or lifting capacity. It has been found that the stability of the vertical tower, which may be additionally secured if necessary, is sufficient. That is, the stability of the vehicle mounted crane of the invention is provided by the intrinsic weight of the vertical tower which acts as a central ballast of the vehicle mounted crane. Depending on the specific dimensioning of the vehicle mounted crane of the invention, additional securing and stabilisation features may be provided for the tower, which will be discussed in more detail below. Such features may contribute to the overall weight of the crane, albeit to a significantly lesser degree than is the case with the counter-weights used with conventional vehicle mounted cranes. The option of working with one or more additional counter-weights in conjunction with the vehicle mounted crane of the invention is not ruled out, however, especially when it is required to lift very high loads or provide the crane with a large reach. Such counter-weights might be of conventional form, or might include at least one auxiliary vehicle or auxiliary crane coupled with the bogie of the vehicle mounted crane of the invention, for example.

A stabiliser system may also be provided for the tower in accordance with the invention. The stabiliser system preferably comprises a plurality of base stabilisers distributed around the tower. The natural weight of the tower and the stabiliser system may be adapted to one another, thereby obviating the need for an additional counter-weight.

Another feature of the invention may include an anchoring system for the tower. The bending resistance of the tower can be increased by using an anchoring system because an anchoring system acting on the tower at a specific height reduces the effective length L of the tower taken into account when calculating the critical bending load on the basis of $1/L^2$. An anchoring system according to the invention may comprise a plurality of anchoring elements distributed around the tower, each of which is provided in the form of a guy anchor. The possibility of imparting a significantly higher load bearing capacity to the tower by means of an anchoring system is one of the advantages of the invention whereby a structure with a vertical tower is provided in the form of a top-slewing system. On the other hand, it is not possible to use an anchoring system with a conventional transportable crane structure which rotates at the bottom.

If the tower employed in a crane according to the invention is a telescopic tower, it is preferable if the anchoring system acts on one or more tower segments (also referred to as boxes or segments). It is of particular advantage to provide an anchoring system on several tower segments and, thus, at points spaced apart along the tower because this enables anchoring at selected points, which results in a particularly high reduction of the effective tower length and thus increases the maximum bending stress which the tower can withstand. This being the case, the anchoring system may be provided in the region of the top ends of the respective tower segments which are accessible when the tower is retracted. According to the invention, an anchoring system acting on various positions spaced apart along the tower may also be provided with a non-telescopic tower.

According to another aspect of the invention, it is of particular advantage if the anchoring system is connected at least partially to a tower stabiliser system. Additional ground anchoring or other anchoring for the anchoring system can be dispensed with as a result, although the invention does not exclude the possibility of using other anchoring systems as an alternative to or in addition to an anchoring system on the tower stabiliser system.

Further according to the invention, an active anchoring system may be provided for the tower, which can be activated depending on load-induced bending moments acting on the tower in order to compensate these bending moments. An active anchoring system of this type makes it possible to react specifically to a load occurring on the tower during operation of the crane because the anchoring system is activated so that the bending moment acting on the tower is compensated. In such a situation it is preferable if the anchoring system is used in a cross-shaped or star-shaped disposition with reference to the tower axis, although other anchoring geometries or configurations could also be used.

A control and/or regulating unit is preferably provided, which determines the degree and direction of any compensation which might be needed during operation of the crane and activates the anchoring system accordingly. This makes it possible to react immediately both to changes in the size of the load and changes occurring in the direction of the load-induced bending moment, especially when the jib is rotating, by activating the anchoring system accordingly. The control and/or regulating unit may have an inclination sensor for determining the inclination of the tower. This being the case, the inclination of the tower axis can be detected relative to the vertical or to a tower platform, or the inclination of a tower head or a reference plane of a top carriage can be detected relative to the horizontal. If necessary, the reference orientations (vertical or horizontal) can be corrected, for example in order to make allowance for unevenness in the ground or sinking of a base stabiliser, for example. The anchoring system may be activated in such a way that it always tries to maintain a pre-defined inclination of the tower and, in particular, is distinctive due to the fact that a platform of a top carriage of the crane is disposed in a horizontal orientation.

The anchoring system preferably acts on the tower by means of tensile forces in order to compensate for load-induced bending moments. This being the case, the anchoring system may act on the tower, on the one hand, and on a tower stabiliser system, on the other hand.

In a preferred embodiment of the invention, the anchoring system comprises a plurality of anchoring elements distributed around the tower, which can be activated independently of one another. Irrespective of the rotational position of the crane, this makes it possible to react to a bending moment acting in any direction by activating an appropriate portion of the anchoring system. The anchoring elements are preferably arranged in a cross-shaped or star-shaped pattern, although in principle any disposition is possible and is specifically selected as a function of tower stabiliser on which the anchoring system acts, and which may be "H"-shaped, for example.

According to another feature of the invention, it may be that the anchoring elements do not act directly on the tower or, in the case of a telescopic tower, on a tower segment. Instead, a jib projecting out from the tower may be provided for each anchoring element, by means of which the anchoring element acts on the tower. Each of these jibs may constitute part of the lattice.

In one embodiment of the invention, the tower is of a telescopic design and the tower stabiliser system comprises a plurality of base stabilisers which are disposed in a cross-shaped or star-shaped pattern. A plurality of anchoring elements of the anchoring system act on a tower segment, on the one hand, and on a respective base stabiliser on the other hand.

It is preferable if every anchoring element is provided with a tensioning system, for example a tensioning cylinder, which is disposed between the anchoring element and the tower or between the anchoring element and a tower stabiliser. Every tensioning system may be provided with a distance measuring system, by means of which the position of the tensioning unit can be determined by reference to a pre-defined base position.

It is also within the scope of the invention that the jib may be provided with a counter-jib. The counter-jib is preferably adjustable so that the bending moment that it imposes on the tower can be varied. To this end, the counter-jib may be length-adjustable, for example of a telescopic design, and/or may be designed so that its angle relative to the tower can be adjusted. Providing a counter-jib means that load-induced bending moments—i.e. acting on the tower via the jib supporting the load to be lifted—can be at least partially compensated. This enables the tower to be kept at least largely free of bending moments.

In one embodiment of the invention, a control and/or regulating unit is provided, by means of which the counter-jib can be adjusted as a function of the load moment at any time. As a result, the tower can also be kept essentially free of bending moments at all times during crane operation by automatically changing the counter-jib position and/or configuration in response to changes in the load situation on the jib, for example by adjusting the length or angular positioning relative to the tower.

According to another feature of the invention, a tower mount may be provided for the bottom end of the tower, which is pot-shaped or cup-shaped and connects two bogie parts spaced apart from one another. As a result, the tower mount constitutes an integral part of the bogie. When the tower is in the transport position, its bottom end is preferably separated from the tower mount. This separation between tower and tower mount permits transportation with the tower lying on the bogie.

It is also preferable if the tower mount is connected to a tower stabiliser system. This enables the tower mount to be simultaneously used as a means of support for it.

Further according to the invention, the tower may be of a self-erecting design. In a preferred embodiment of the invention, at least two length-adjustable adjusting mechanisms are provided as a means of erecting the tower, which act on positions spaced apart along the tower.

In particular, the tower can be transferred by means of a first adjusting mechanism acting at a distance from the bottom end of the tower from an essentially horizontal transport position into an inclined position, and by means of a second adjusting mechanism acting in the region of the bottom end of the tower from the inclined position into the vertical working position. This being the case, it is preferable if the tower is forcibly guided in the region of its bottom end, and is so in particular in an at least approximately horizontal direction.

The erection principle in accordance with the invention, whereby the tower is not merely pivoted about an axis which remains stationary relative to the bogie but a preferably horizontally extending translating movement is also superimposed on the pivoting movement of the tower, results in an advantage that the transport position of the tower in relation to the bogie can be optimally adapted to transport requirements because the position of the bottom end of the tower need not be fixed.

The fact that mechanisms for erecting a crane in accordance with the invention might be considered to be "on-board" (i.e., normally carried by the transportable crane) does not rule out the option of erecting the tower assisted by an external auxiliary mechanism or apparatus, such as an auxiliary crane, especially if the vehicle mounted crane of the invention is designed for very high lifting capacities.

Further in accordance with the invention, the tower may be erected with the jib fitted. Depending on the dimensions of the tower and the jib, the tower may be erected with the jib fitted, either solely on the basis of its own power or assisted by external auxiliary mechanisms. It is preferable, in accordance with another aspect of the invention, that a retaining mechanism in the form of a rigid steering arm is provided, which holds the angularly adjustable jib fitted on the tower in an approximately horizontal position during the erection operation, irrespective of the inclination of the tower. This ensures that the fitted jib remains in a desired position relative to the bogie, at least within certain limits, during the process of erecting the tower in spite of the increasing angle between the tower and the jib. This desired position of the jib may also vary from a horizontal position, although an essentially horizontal orientation of the jib is typically preferred.

In accordance with another aspect of the invention, the tower is disposed on the bogie provided in the form of a flat-bed truck or trailer while the jib, in particular the top carriage incorporating the jib, is provided with a separate transport unit. Each transport unit is configured to be suitable for driving on the roads. It has been found that it is sufficient if the tower and jib or top carriage are each of dimensions authorised for road transport as a whole in keeping with current traffic regulations. Any crane components optionally provided in addition, such as tower stabiliser system, tower anchoring system and a retaining mechanism used to assist the erection operation, may be grouped in another transport unit. The vehicle mounted crane according to the invention can, therefore, be transported in road traffic with at most three individual transport units due to its low overall weight relative to its carrying or lifting capacity. This means that the logistics involved in transporting it to the respective deployment site are reduced to a minimum and, at the same time, a minimum amount of space is required on site during the erection operation with a relatively low risk of damage to the ground.

As a result of the invention, therefore, the costs incurred in the use of a crane can be significantly reduced. This is especially advantageous for special needs, such as for erecting large wind turbines.

BRIEF DESCRIPTION OF THE DRAWINGS

The invention will be best understood upon consideration of the following detailed description below of particular examples and embodiments, with reference to the appended drawings in which:

FIG. 1 shows three different views of part of a vehicle mounted crane according to the invention. FIG. 1 depicts a first transport unit suitable to drive on the roads, comprising a bogie with a front bogie part 23*a*, which can coupled to an articulated tractor for pulling the bogie, and a rear bogie part 23*b*. A pot-shaped tower mount 21 connecting the two bogie parts 23*a*, 23*b* to one another is fixedly integrated in the bogie.

Figure 1:
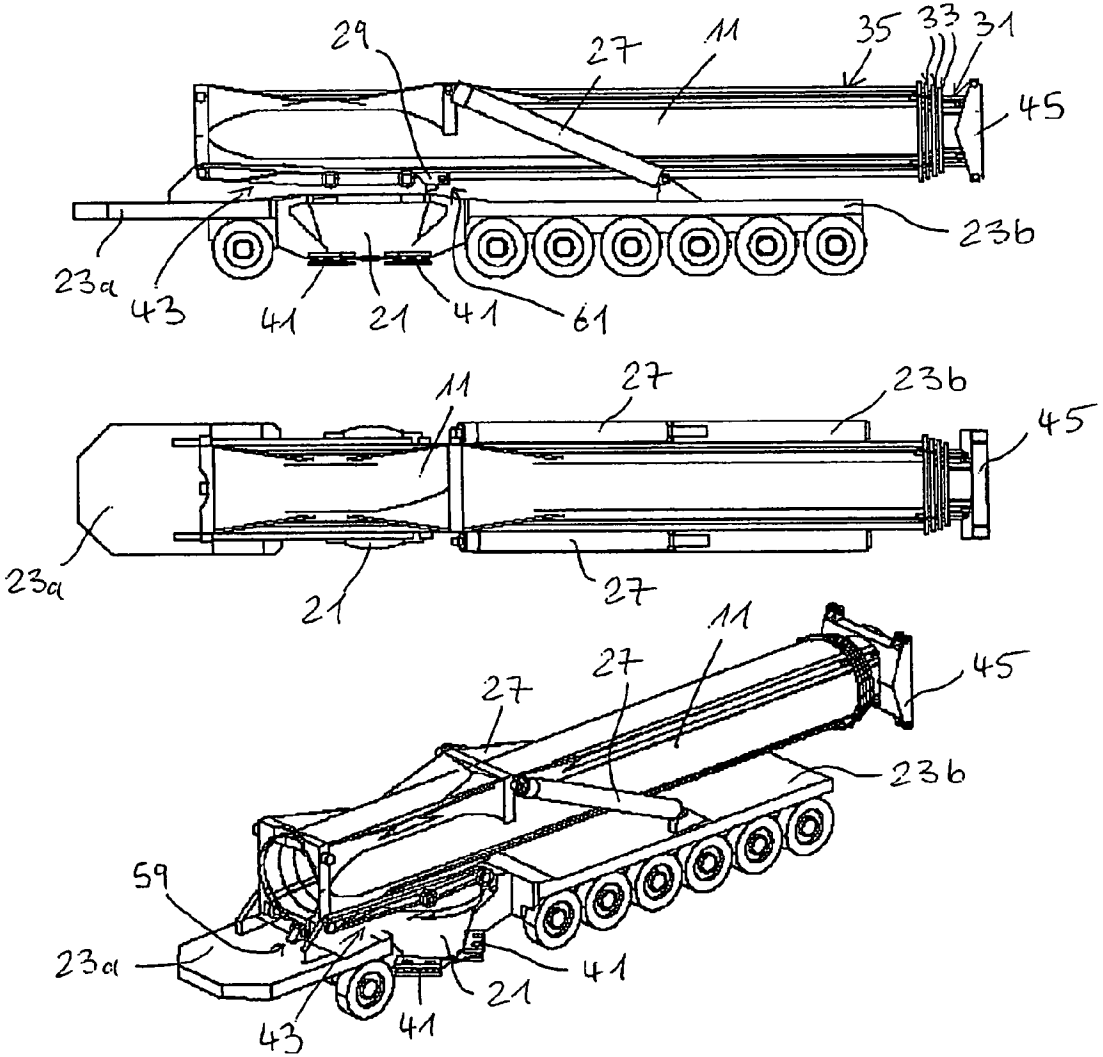
FIG. 1—illustrates the tower portion of a crane according to the invention in a transport position on a flatbed vehicle.

The tower mount 21 is provided with a plurality of connection points 41 for mounting a tower stabiliser system, which will be described in more detail below. This is used to accommodate the bottom end of a tower 11, which is illustrated in its lying-down transport position in FIG. 1. In this transport position, the tower 11 extends transversely beyond the tower mount 21 and lies on the bogie 23*a*, 23*b*.

The tower 11 is telescopic and, in the embodiment illustrated as an example, comprises five tower segments (also referred to as boxes or sections). A bottom tower segment or outer box is identified by reference numeral 35. Three inner or intermediate tower segments are identified by reference numeral 33, and the inner-most tower segment at the upper end of the extended tower (see also FIG. 7*a*) is identified by reference numeral 31. Segment 31 has a head 45 on its free end, on which a component comprising a jib hereafter also referred to as top carriage, not illustrated in FIG. 1, can be fitted.

Two adjusting mechanism 27, 29, which will be described in more detail later, are used to erect the tower 11, which will also be described in more detail later. A first adjusting mechanism 27 comprises a pair of piston/cylinder devices which are pivotally connected, on the one hand, to the rear bogie part 23*b* and on the other hand to a point on the top face of the bottom tower segment 35 at a distance from the bottom tower end and remote from the bogie 23*a* in the lying-down transport position of the tower. A second adjusting mechanism 29 comprises a piston/cylinder arrangement extending essentially parallel with the lying-down tower 11, the cylinder of which is linked by a front end to a fixing point 59 on the front bogie part 23*a*. In the retracted state, the front end 61 of the piston of the piston/cylinder arrangement 29 lies in the region of the rear end of the tower mount 21. By means of a tensioning linkage in the form of a yoke, not illustrated in FIG. 1, the front piston end 61 is connected to the bottom tower end on the bottom face of the tower facing the bogie in the transport position illustrated. The bottom tower end can therefore be pulled backwards and across the tower mount 21 by extracting the piston, as will be explained in more detail below.

Although not illustrated in FIG. 1, a retaining mechanism in the form of a rigid steering arm is provided as a means of erecting the tower 11 and will likewise be explained in more detail below. One end of the steering arm is attached to the front piston end 61 and its other end supports the top carriage positioned on the head 45 as the tower 11 is being erected.

An essentially horizontally extending guiding element 43 is also provided for the bottom tower end, comprising two slots or elongate holes extending parallel at a distance apart in which the bottom tower end is engaged by means of co-operating guide projections.

Figure 2:
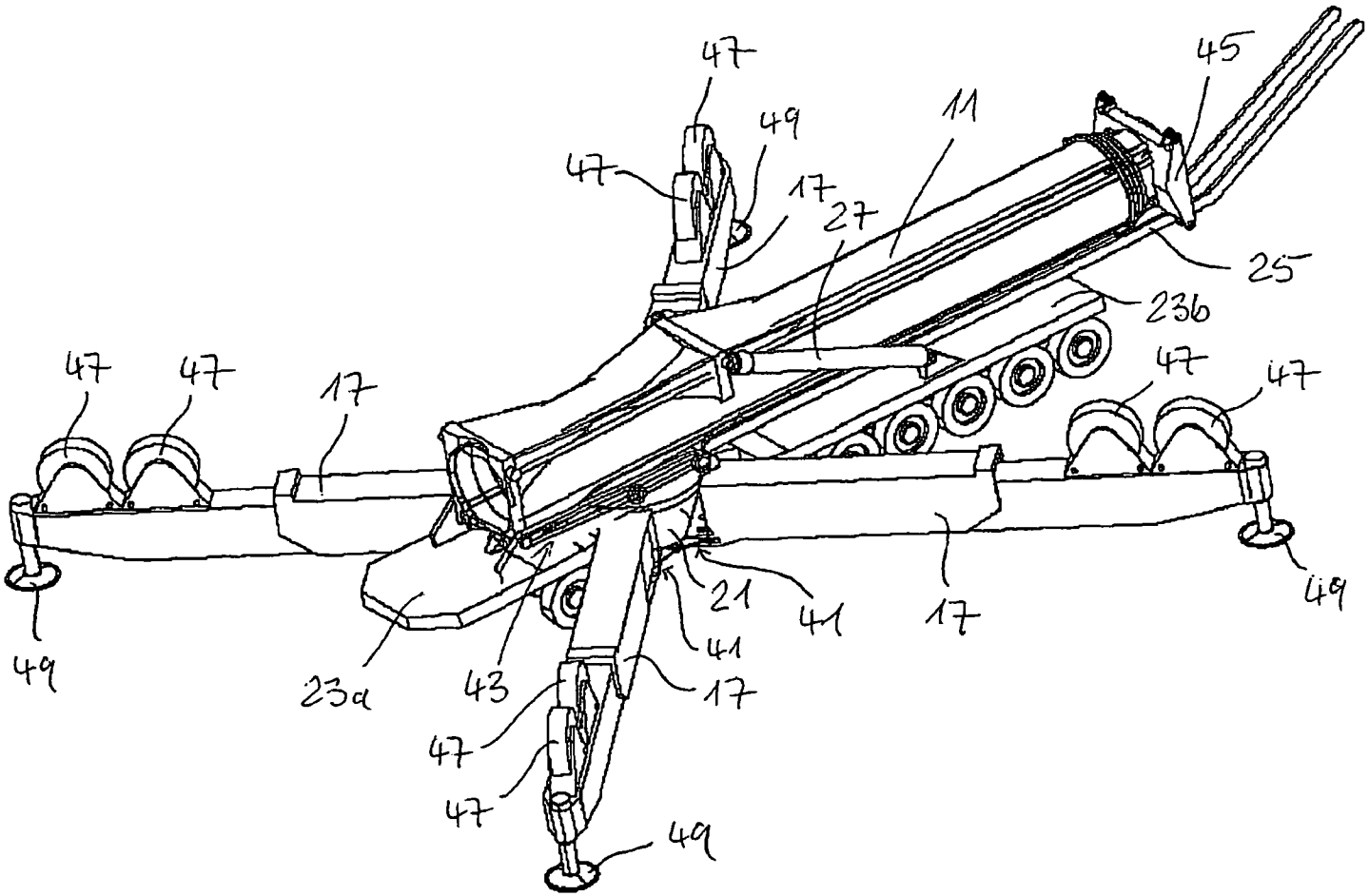
FIG. 2 illustrates the crane of FIG. 1 with stabiliser elements attached thereto.

FIG. 2 illustrates the steering arm 25 mentioned above, in the mode connected to the front piston end 61. The steering arm 25 extends parallel with the tower 11 and is angled upwards at its end region projecting above the head 45 when the tower 11 is retracted.

FIG. 2 also illustrates four extendable-retractable base stabilisers 17 forming a star-shaped stabiliser system for the vehicle mounted crane and its tower 11. The base stabilisers 17 are connected to the tower mount 21 at the connection points 41 as are evident in FIG. 1. At their end regions remote from the tower mount 21, the base stabilisers 17 are each provided with a stabiliser foot 49 and two winches 47 at the top. The winches 47 may be provided with a brake mechanism based on a pawl or catch principle, for example. The winches 47 are part of a tower anchoring system which will be explained in more detail below.

Figure 3:
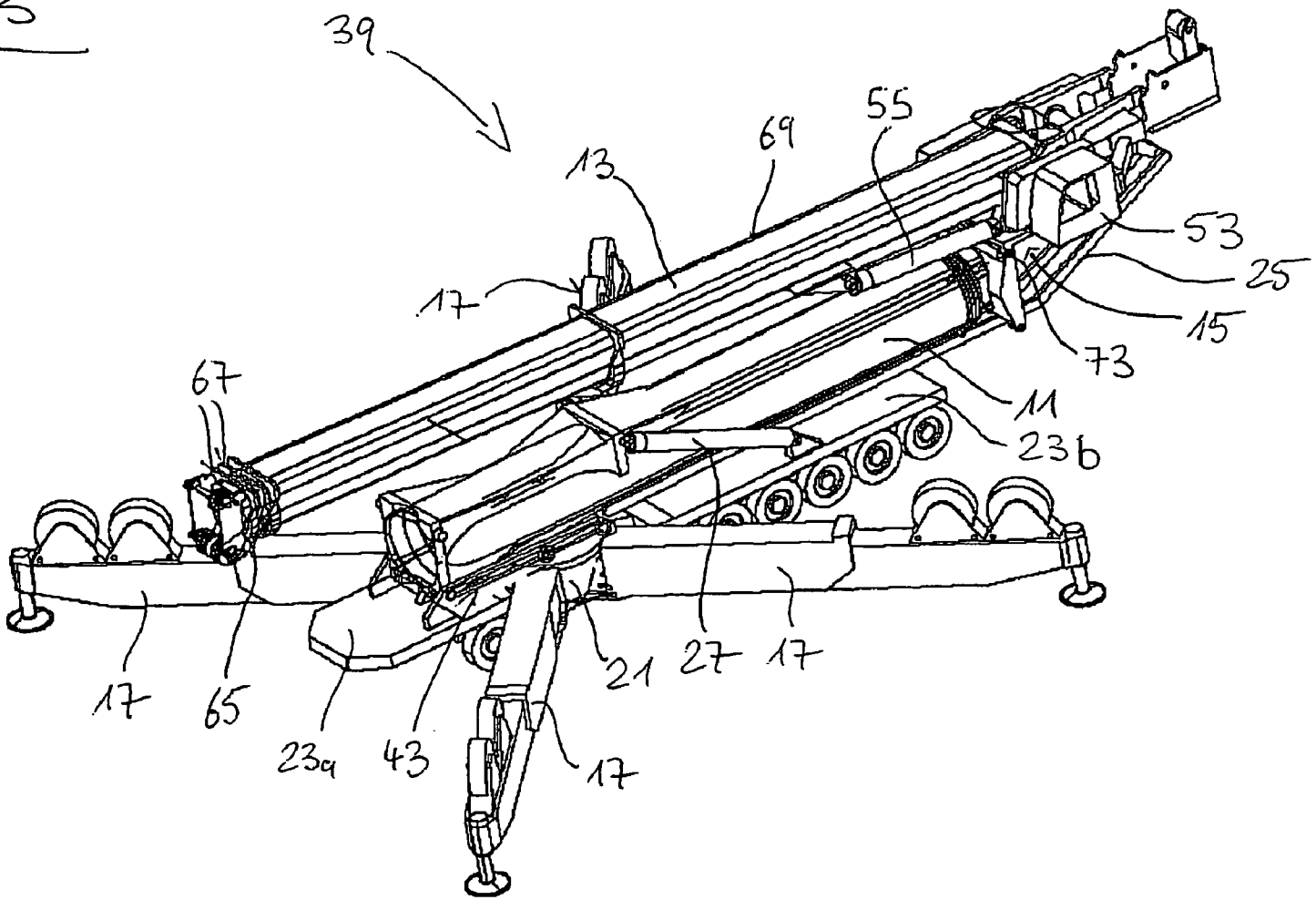
FIG. 3 illustrates the crane of the invention with a jib mounted to the tower portion thereof.

FIG. 3 illustrates a vehicle mounted crane according to the invention with the top carriage 39 fitted. The top carriage 39, which may be transported by a different transport unit (not illustrated) suitable for driving on the roads, has a jib 13 comprising a telescopic mast with four mast segments in the embodiment illustrated as an example here. In the exemplary embodiment the jib comprises a top mast segment 65 having a bottom block and pulley, two intermediate segments or boxes 67, and a bottom or base mast segment 69. Base segment 69 is connected to a luffing unit 55 and slewing unit 15. In addition to the jib 13, the top carriage 39 in the embodiment illustrated as an example has a crane driver's cab 53, the drive units for the slewing unit 15 and the luffing unit 55, as well as hoists.

The rigid steering arm 25 is pivotally linked at its free end comprising the angled end region to the rear end portion of the top carriage 39. In the position illustrated in FIG. 3, the top carriage 39 is linked to the head 45 at only one end of head 45 so that it can pivot about an axis 73, thereby permitting an angular displacement between the top carriage 39 and jib 13 when the tower 11 is being erected, as will be described below.

Figure 4:
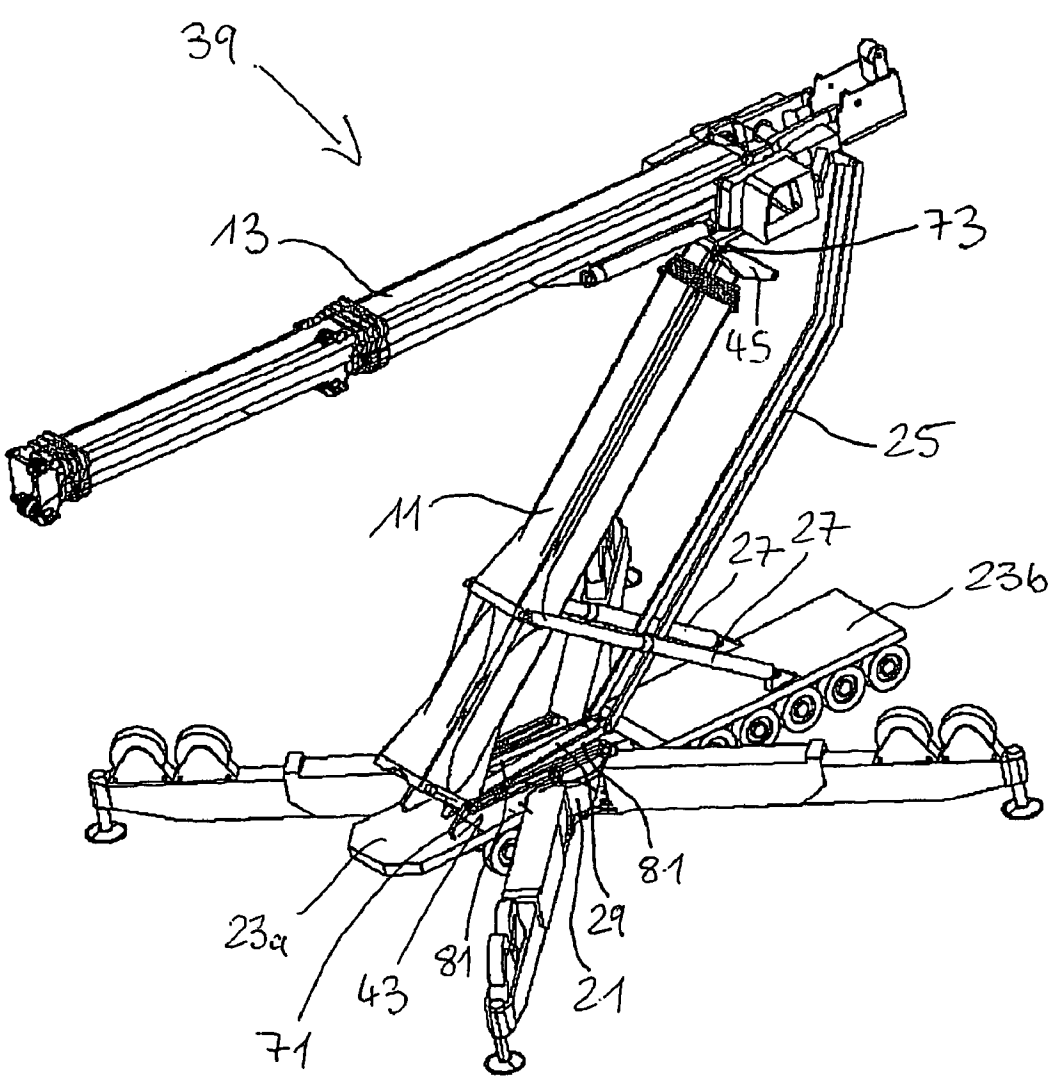
FIG. 4 illustrates the crane of the invention in a partly erected state.

In order to erect the tower 11 with the top carriage 39 fitted, the tower 11 is firstly raised from its horizontal transport position by means of the first adjusting mechanisms 27 into the inclined position in which the tower 11 is inclined at, for example, approximately 45° with respect to the vertical, as illustrated in FIG. 4. Up to this point, the movement by which the tower 11 is erected is a pure pivoting movement about an axis 71 at the one end of the forced guiding element 43 for the bottom tower end. In the position illustrated in FIG. 4, the second adjusting mechanism 29 remains still in the retracted state. FIG. 4 illustrates the tensioning rod linkage or yoke 81, which is largely covered in FIGS. 1 to 3.

The rigid steering arm 25, linked to jib 13 as noted above, maintains the jib 13 in a generally horizontal position during the changing inclination of the tower as it is being erected. In order to obtain forces and moments conducive to erecting the tower 11, the inner segments 67 and 65 of the telescopic mast of the jib 13 are extended in the direction of the front of the bogie 23*a*, as illustrated in FIG. 4. As a result, the centre of gravity of the jib 13 and the top carriage 39 is shifted toward the front, away from the pivot axis 73 between the top carriage 39 and tower 11, which facilitates lifting of the tower by adjusting mechanisms 27.

Figure 5:
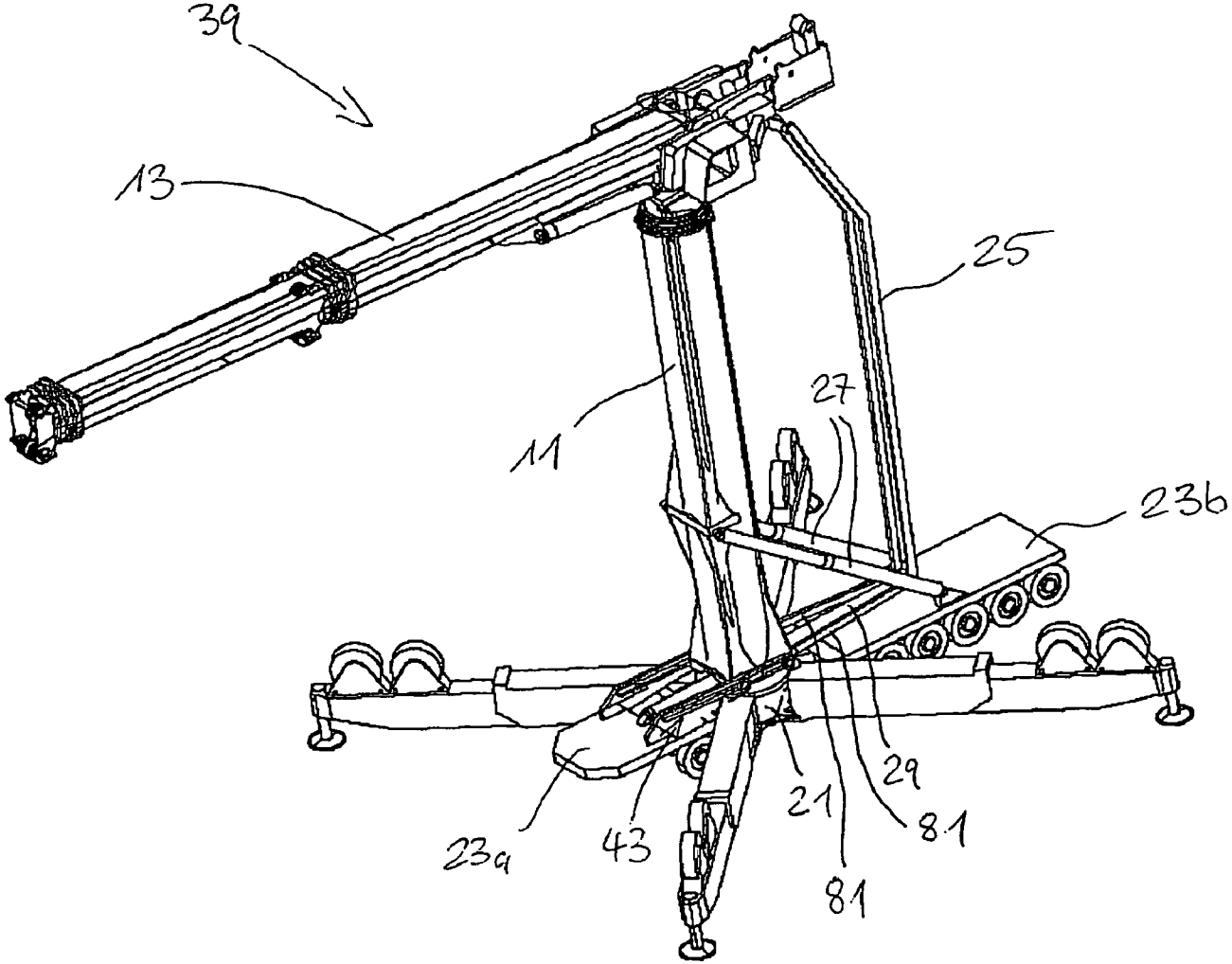
FIG. 5 illustrates the crane of the invention with the tower raised to a vertical position.

FIG. 5 illustrates the tower 11 in the fully erected state or working position in which it extends in the vertical direction. To achieve this state, the tower 11 is transferred from the inclined position illustrated in FIG. 4 into the working position by means of the second adjusting mechanism 29 by extracting the piston of mechanism 29 so that the bottom end of tower 11 is pulled by means of the tensioning rod linkage or yoke 81 onto the tower mount 21. The bottom tower end is then secured, for example by bolting. The bottom end of the rigid steering arm 25 is likewise pushed backwards, that is, in the direction of rear end 24*a* of the bogie.

The positions of all the pivot axes, as well as the lengths of all the components involved, are adapted to one another for erecting the tower in accordance with the invention and are selected so that, as the tower 11 is being raised the steering arm 25 linked to the top carriage 39, which is in turn pivotally mounted on the tower 11, the top carriage 39 is always held in a generally horizontal position during the entire erection operation irrespective of the tower inclination.

Figure 6:
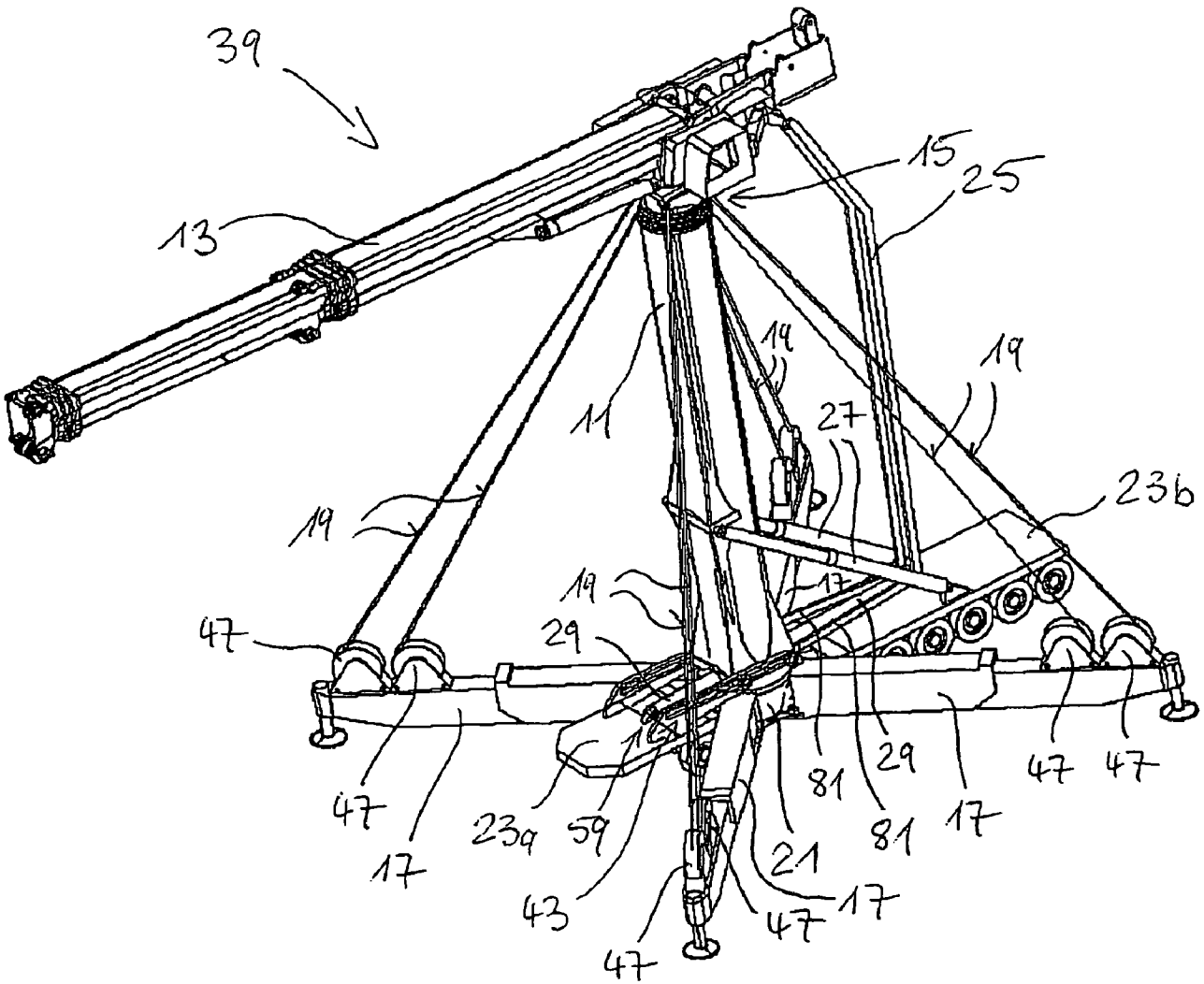
FIG. 6 depicts the crane with guying elements in place for stabilizing the tower.
Figure 7A:
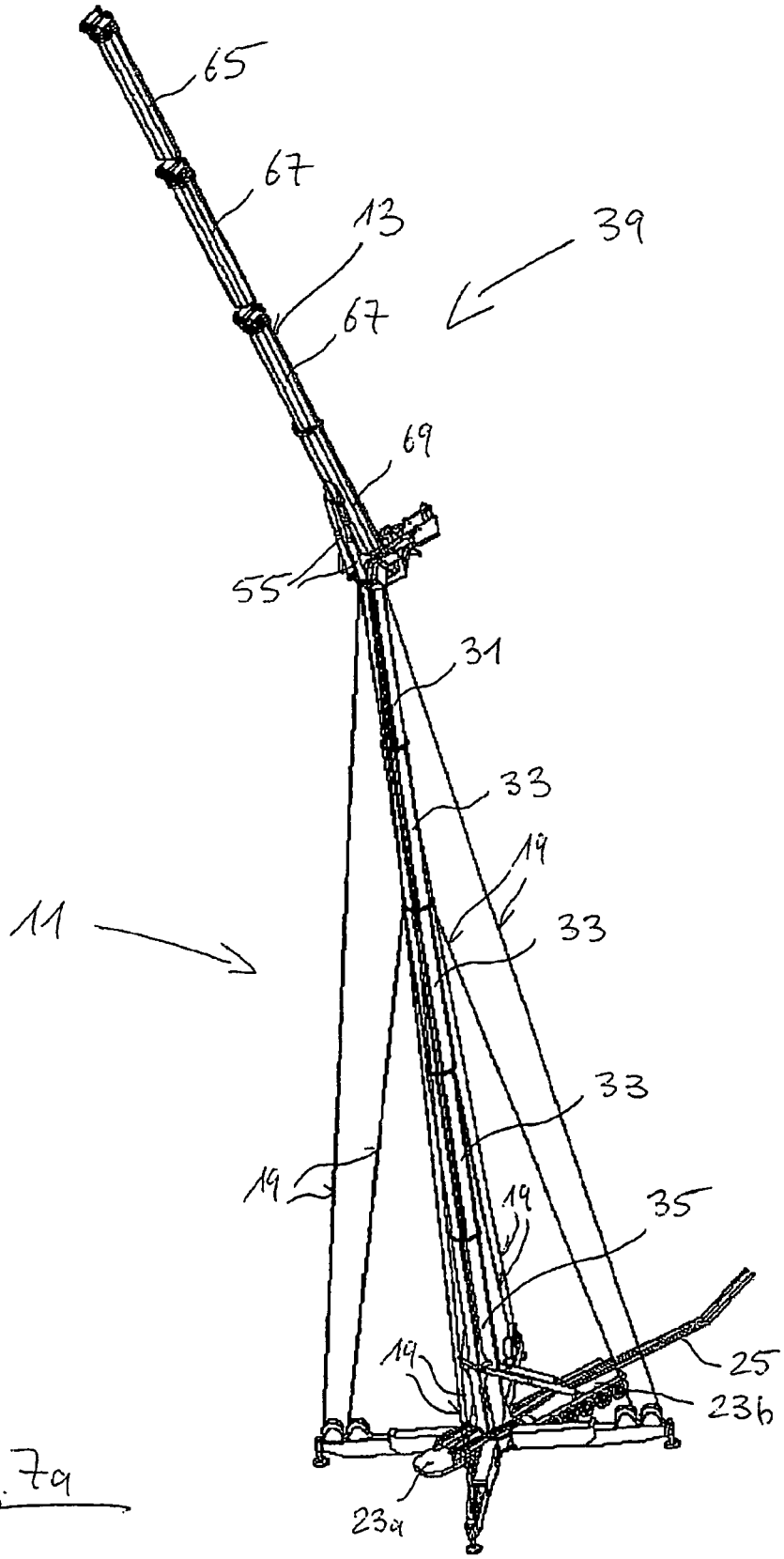
FIG. 7*a* depicts the crane of the invention with its tower and jib extended in a manner generally suitable for operation.

Once the tower 11 has been brought to the vertical working position, a star-shaped anchoring system is fitted to the crane, as illustrated in FIG. 6. With the sections of the telescopic tower 11 still retracted within each other, two guy anchors 19 are wound on the two respective winches 47 attached to the base stabilisers 17 for each of the four base stabilisers 17. The free ends of the two guy anchors on each of the stabilisers are attached to respectively different tower segments at the upper peripheral region of each respective segment. As illustrated in FIG. 7*a*, one guy anchor from each stabiliser might be secured to the upper-most tower segment 31 while the other may be secured to an intermediate tower segment. Clamping mechanisms for clamping the guys 19 are integrated in the base stabilisers 17.

Once transferred to the vertical position, supported and anchored in the manner described above, after fitting the top carriage 39, the tower 11 can now be telescoped to the desired working length (height) by releasing the connection between the rigid steering arm 25 and top carriage 39, as illustrated in FIG. 7*a*. The guy anchors 19 are unwound from the winches 47 as the tower height increases and can therefore be constantly held under tension.

At the same time as the tower 11 is being erected, or once the respective working length of the tower 11 is reached, the telescopic mast of the jib 13 can be extended and moved to the desired angular position relative to the tower 11 by means of the luffing unit 55 in order to move the jib tip into the desired working position with regard to height and radius. The vehicle mounted crane proposed by the invention is thus ready for deployment.

Figure 7B:
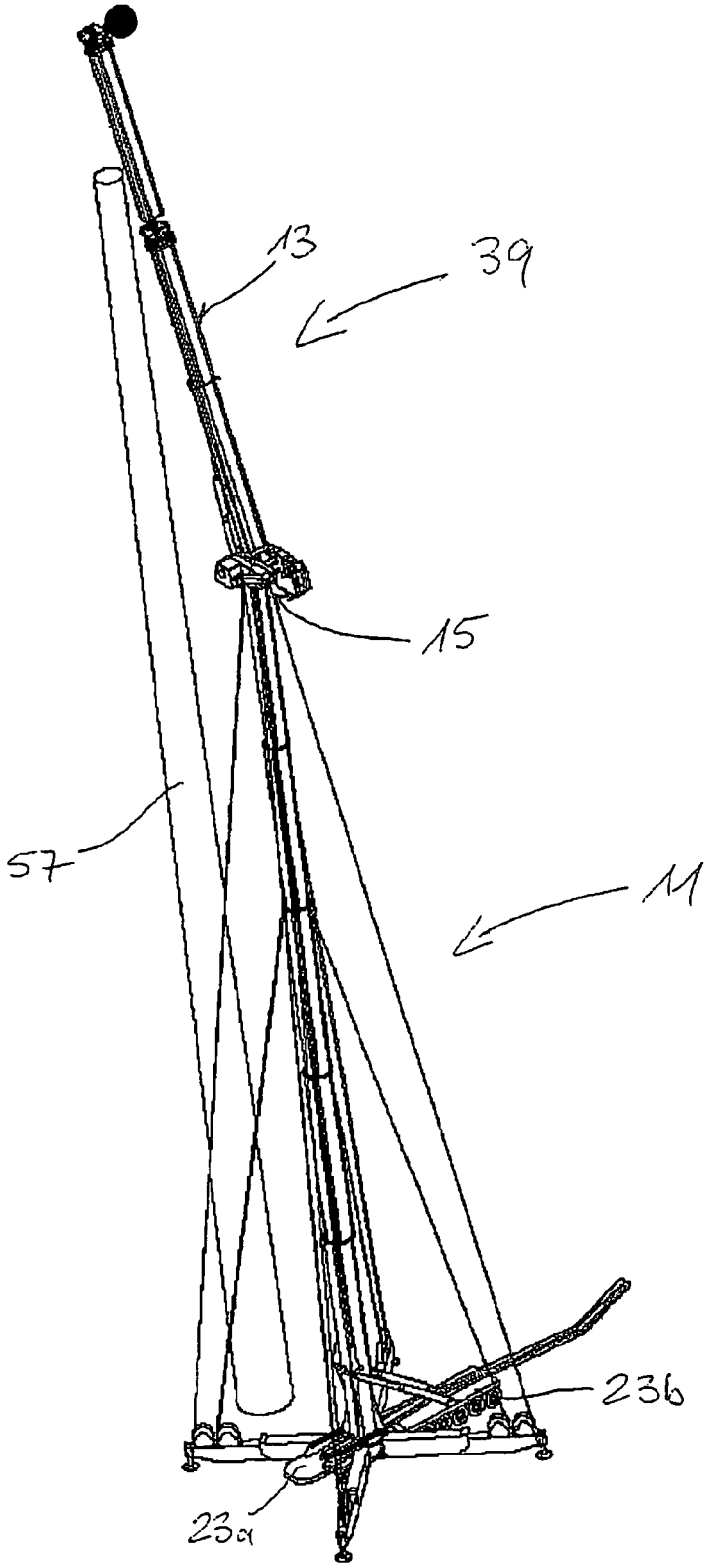
FIG. 7*b* is similar to FIG. 7*a*, illustrating how a crane in accordance with the invention can be positioned close to a structure on which it is operating.

FIG. 7*b* provides a schematic illustration of a vehicle mounted crane according to the invention in the immediate vicinity of, for example, a tower 57 of a wind turbine to be erected. A major advantage of the vehicle mounted crane proposed by the invention resides in the fact that because of its vertical tower 11, the base of the crane can be positioned relatively close to the tower 57 of the wind turbine while still able to reach the uppermost part of the tower 57 for raising the tower 57 and/or lifting components to the upper part of the tower.

Figure 8:
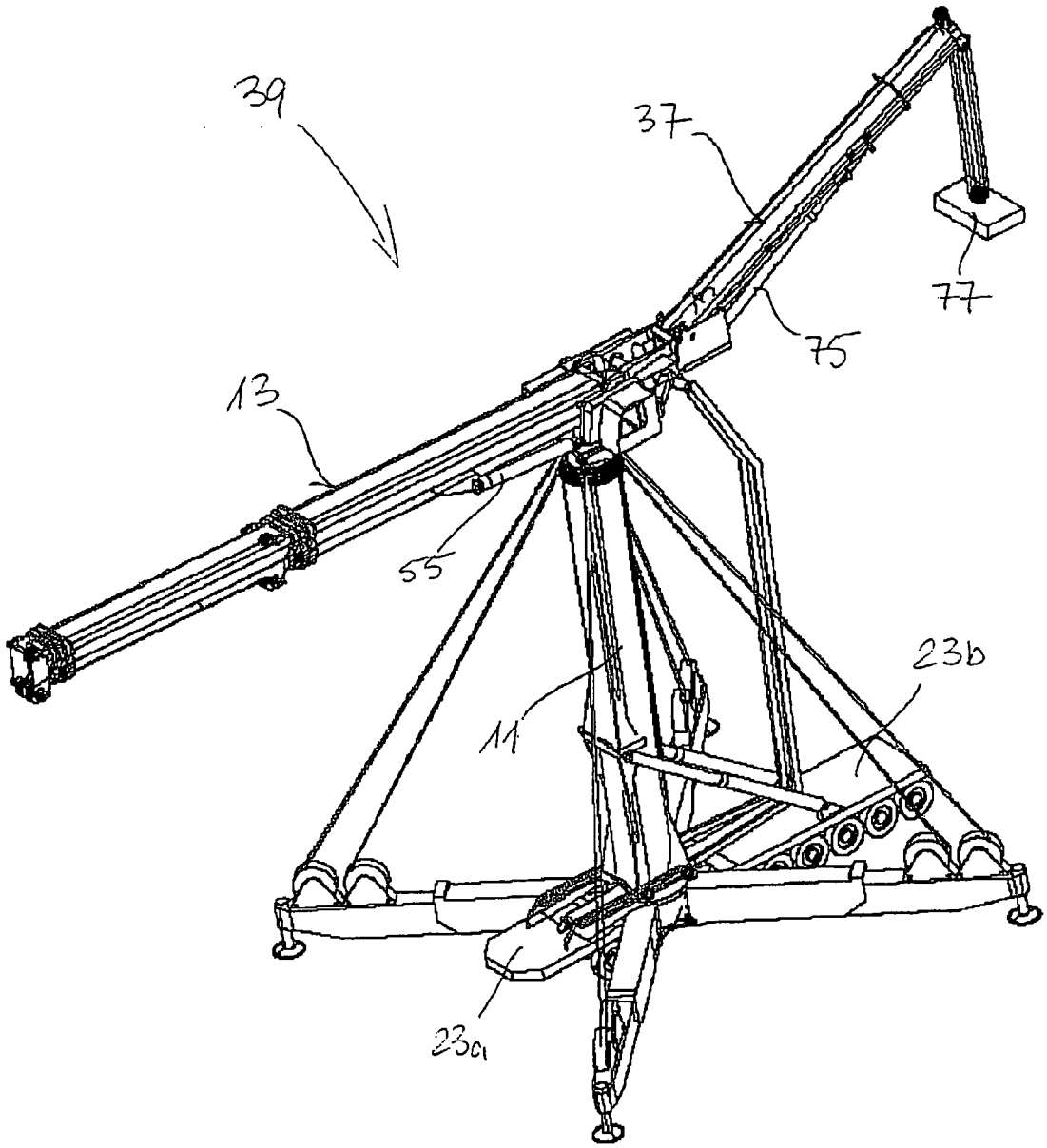
FIG. 8 illustrates a first possible additional feature of a vehicle mounted crane according to the invention.

FIG. 8 illustrates a vehicle mounted crane that includes an additional feature as compared with the exemplary embodiment described above. In this embodiment an additional counter-jib 37 is provided. Like the jib 13, the counter-jib 37 comprises a telescopic mast and its angle can be adjusted relative to the jib 13 and the tower 11 by means of a luffing unit 75. The counter-jib 37 may be provided with a supplemental ballast 77 hanging down from its mast tip via a block pulley. The counter-jib 37, including the ballast 77, is dimensioned so that it can compensate for load-induced bending moments acting on the tower 11, via the jib 13 carrying the load to be lifted, by a corresponding counter-moment. Due to its adjustability in terms of length and angle, the counter-jib 37 can be adapted to varying load and moment situations on the jib 13 side of the crane. The vehicle mounted crane according to the invention may be provided with a device which determines the instantaneous load or the instantaneous moment on the jib 13 by means of an appropriate sensor system and, on the basis of such determination, adjusts the counter-jib 37 so that the tower 11 is held at least largely free of bending moments during operation, i.e. is loaded with a compressive force in substantially only the vertical direction. This makes it possible to react to jib-side changes by varying the settings on the counter-jib 37 with practically no delay.

Figure 9:
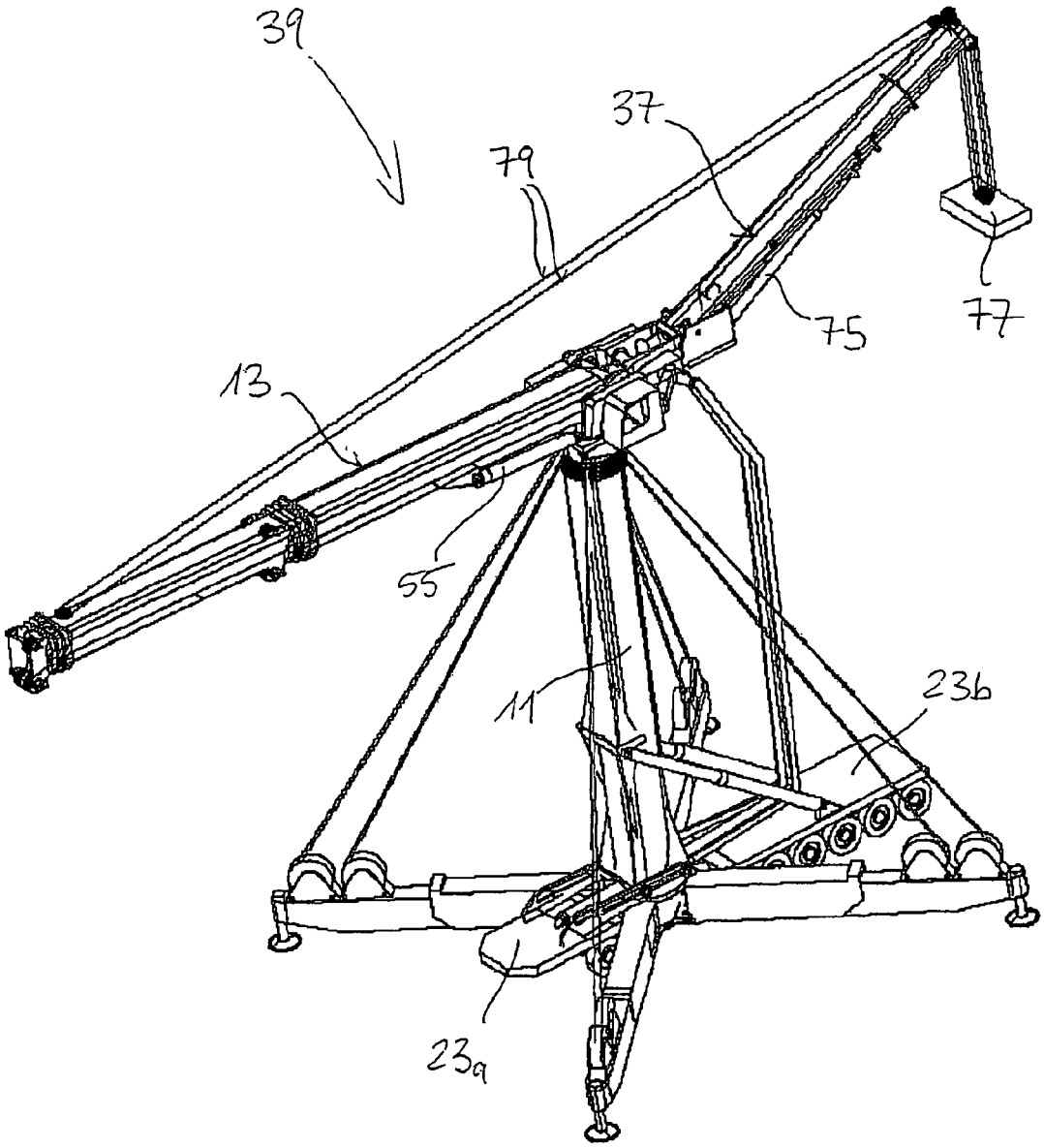
FIG. 9 shows a second possible additional feature for a vehicle mounted crane as illustrated in FIG. 8, and FIGS. 10-11 illustrate an example of an embodiment of a vehicle mounted crane according to the invention, which comprises an alternate form of guying elements, in different phases of erection.
Figure 10:
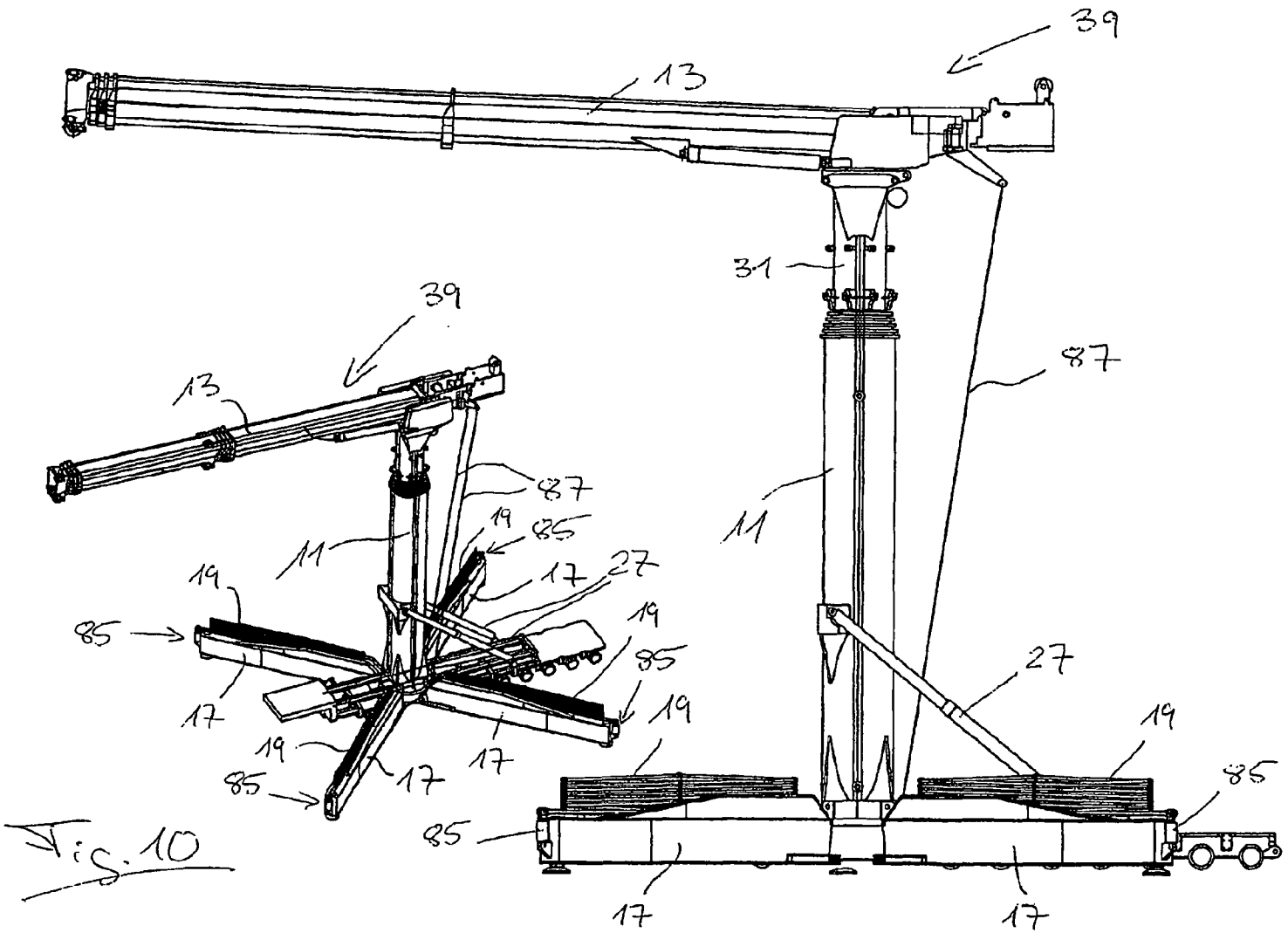

As illustrated in FIG. 9, a crane according to the invention as illustrated in FIG. 8 may comprise an additional guy anchor 79 extending between the jib 13 and the counter-jib 37. The length of the guy anchor 79 can be varied as a function of the angle between the jib 17 and counter-jib 37, which variation in length can be accomplished by means of a separate block pulley on the counter-jib 37. The guy anchor 79 relieves strain on the luffing units 55, 75.

The operating radius of the vehicle mounted crane in accordance with the invention can be limited to the amount needed for the respective lifting job and hence to the minimum necessary as a result of the vertical tower 11. This being the case, the vehicle mounted crane proposed by the invention is not subject to the crane radius (lifting radius) needed for conventional cranes. This makes it possible to use the intrinsic weight of the tower 11 as central ballast, at least partially obviating the need for the usual counter-weight used with conventional vehicle mounted cranes. If needed at all, only a relatively low counter-weight can be provided for the stabilisation system 17 of the tower 11.

The top-slewing design according to the invention makes it possible, by obviating any need for the tower 11 to rotate, to provide the guy anchors 19 to counteract bending moments imposed upon tower 11. As a result, the load bearing capacity of the tower 11 can be increased, which in turn makes additional counter-weights superfluous. The standing stability achieved by the vertical tower 11 itself requires only a relatively low counter-weight for the stabiliser system 17 of the tower 11, if any at all.

An additional possible feature of a vehicle mounted crane according to the invention is illustrated in FIGS. 10-13. The subject matter depicted in FIGS. 10-13 corresponds to the embodiments described as examples above. Corresponding components are therefore denoted by the same reference numbers.

The rigid steering arm 25 provided in the embodiments of the vehicle mounted crane described as examples above is replaced by two stay cables 87 extending parallel to each other. The stay cables 87 extend between the rear end region of the top carriage 39 and the bottom end of the tower 11. The way in which the stay cables 87 work as the tower 11 is being erected corresponds to that of the rigid steering arm 25. Due to the stay cables 87, the top carriage 39 is always held in a generally horizontal position during the entire erection operation irrespective of the tower inclination.

Another difference compared with the embodiments described above is the design of the guy anchor 19. The above-described embodiments are provided with an active cross-shaped guy anchor 19. The embodiment of FIGS. 10-13 comprises four separate anchoring elements 19 in the form of foldable anchoring rods. In the folded transport mode illustrated in FIG. 10, each anchoring rod 19 lies directly on a respective base stabiliser 17.

Figure 11:
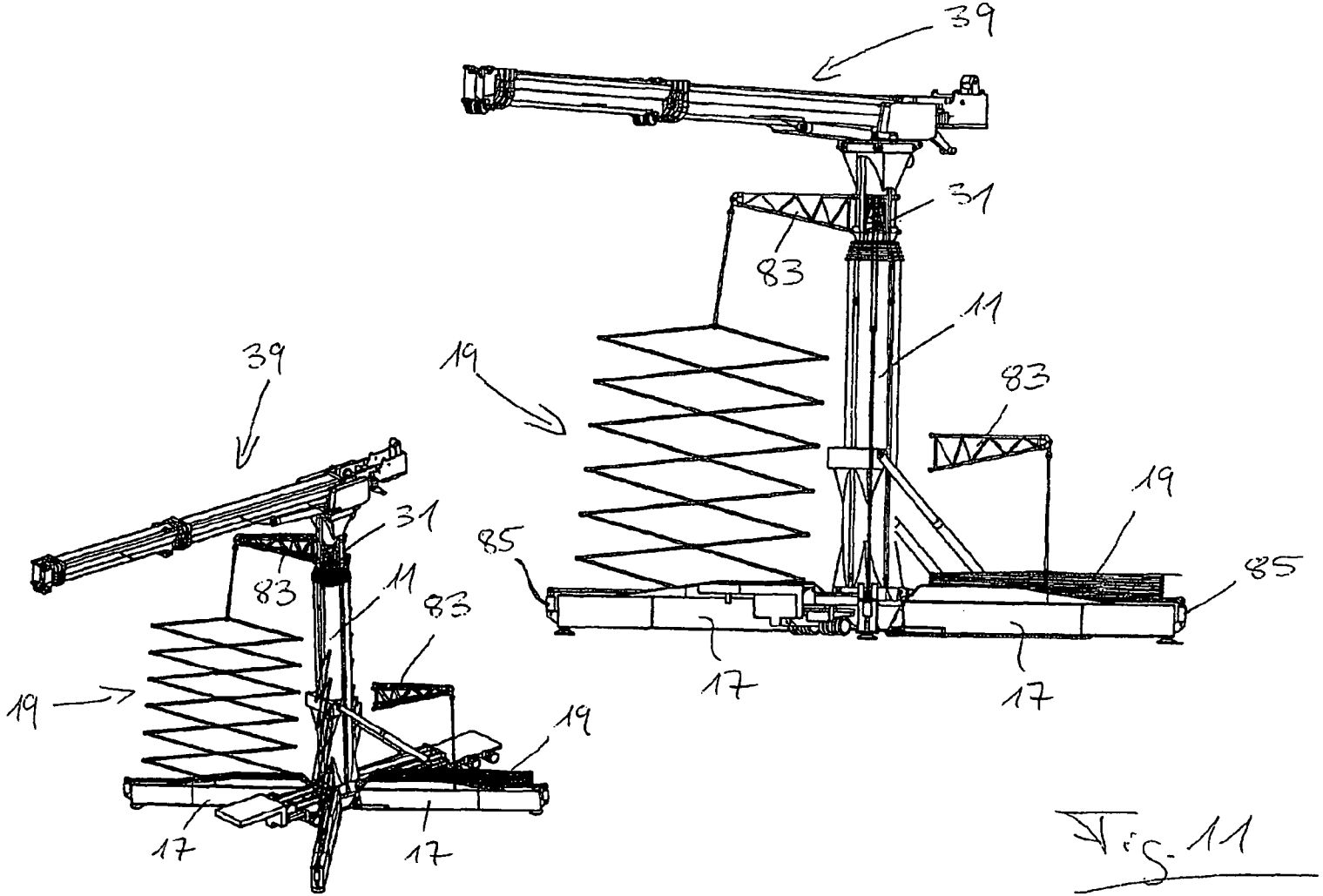

One end of each anchoring rod 19 is coupled with a tensioning cylinder 85 provided at the free end of the base stabiliser 17. The other end of every anchoring rod 19 is free and is attached to the top tower segment 31 during the course of erecting the crane by means of a jib 83 in the form of a lattice part (FIG. 11). Once the tower 11 has been extended (FIG. 12), the now completely unfolded elongate anchoring rods 19 extend between a lattice jib 83 attached to the top tower segment 31 and the tensioning cylinder 85 mounted on the co-operating base stabiliser 17. By operating the tensioning cylinder 85, tensioning forces can be applied via the anchoring rods 19 and the lattice jib 83 to the top end of the tower 11. This serves to "pull" the tower 11 in the direction of the relevant lattice jib-base stabiliser pair 83, 17. Due to the cross-shaped or star-shaped disposition of the several individual anchoring rods 19, the tower 11 can be pulled in any direction as a result. The tensioning cylinders 85 can be activated separately from one another so that, by superimposing all of the tensioning forces acting on the tower 11 by means of the tensioning cylinders 85, a specifically pre-defined and/or desired tensioning force can be applied to the tower 11 selectively in terms of amount and direction. Applying tensioning forces to the tower 11 in this manner compensates for load-induced bending moments acting on the tower 11 during operation of the crane.

Although not illustrated, a control and/or regulating unit is normally provided for this purpose, by means of which the tensioning cylinders 85 can be activated independently of one another. The tensioning cylinders 85 are preferably connected to the central hydraulic system of the top carriage 39. In addition to what is illustrated in FIGS. 10-13, the tensioning cylinders 85 may also be disposed at the top end of the anchoring rods 19, namely between the anchoring rod 19 and free end of the co-operating lattice jib 83 respectively. This simplifies the connection of the tensioning cylinders 85 to the hydraulic system of the top carriage 39.

The control and/or regulating unit may also include an inclination sensor for operation of the tensioning cylinders 85, by means of which the actual status of the tower inclination can be determined whilst the crane is operating. The inclination sensor is preferably mounted on the top carriage 39, in which case the control and/or regulating unit is designed so that it works to achieve a horizontal orientation of a top carriage platform. Every tensioning cylinder 85 may be provided with a distance measuring system which can always find a "zero position" serving as a reference point for positioning movements automatically with the aid of the inclination sensor by ensuring that the zero position of the tensioning cylinders 85 corresponds to said horizontal orientation of the top carriage 39.

Changes in the tower inclination are caused by changes in the size of the load, changes in the inclination of the jib 13 of the top carriage 39 and/or by changes in the rotational position of the top carriage 39. The active anchoring system proposed by the invention can react immediately to changes in the tower inclination caused by changes in the load-induced bending moments acting on the tower 11. The inclination sensor signals an associated change in inclination to the central control and/or regulating unit and corresponding positioning signals are calculated for the tensioning cylinders 85 on the basis of the amount and direction of the change in inclination. Such signals are transmitted, on the basis of which the tensioning cylinders 85 are activated so that the tower 11 is "pulled" in the opposite direction, compensating for the bending moments accordingly.

The compensation control system proposed by the invention is fast enough to effect the requisite change in the compensation direction, even when the top carriage 39 is rotating, because the tensioning cylinders 85 are activated to a certain extent "in real time" in order to effect correspondingly fast positioning movements.

If the jib 13 is disposed above a base stabiliser-lattice jib pair 17, 83, tensioning forces acting on the tower 11 are applied in the opposite direction virtually exclusively by the rod 19 tensioned between the diagonally opposite base stabiliser-lattice jib pair 17, 83, whilst the two adjacent tensioning cylinders 85 essentially assume only the function of providing lateral stability. If, on the other hand, the jib 13 of the top carriage 39 is disposed between two guy anchors, the two opposite tensioning cylinders 85 must pull on the tower 11 together in order to compensate for the instantaneous bending moment. The tensioning forces of the two tensioning cylinders 85 must be dimensioned so that the resultant tensioning force at least reduces the bending moment and moves the top carriage 39 at least essentially back into the pre-defined desired position.

This method of compensating load-induced bending moments proposed by the invention therefore works using a plurality of active guy anchors 17, 19, 83, 85 distributed around the tower 11, which can be activated independently of one another.

In the embodiment illustrated in FIGS. 10-13, the anchoring rod linkages 19 fold in the manner of shear joints. Any configuration may be chosen for the guy anchors in the transport mode. Instead of anchoring rods or rod linkages, it would also be possible to provide anchoring cables in this embodiment.

The lattice jib 83 may be assembled with and/or secured to the top tower segment 31 by means of an auxiliary crane, for example, although this is not illustrated.

Figure 13:
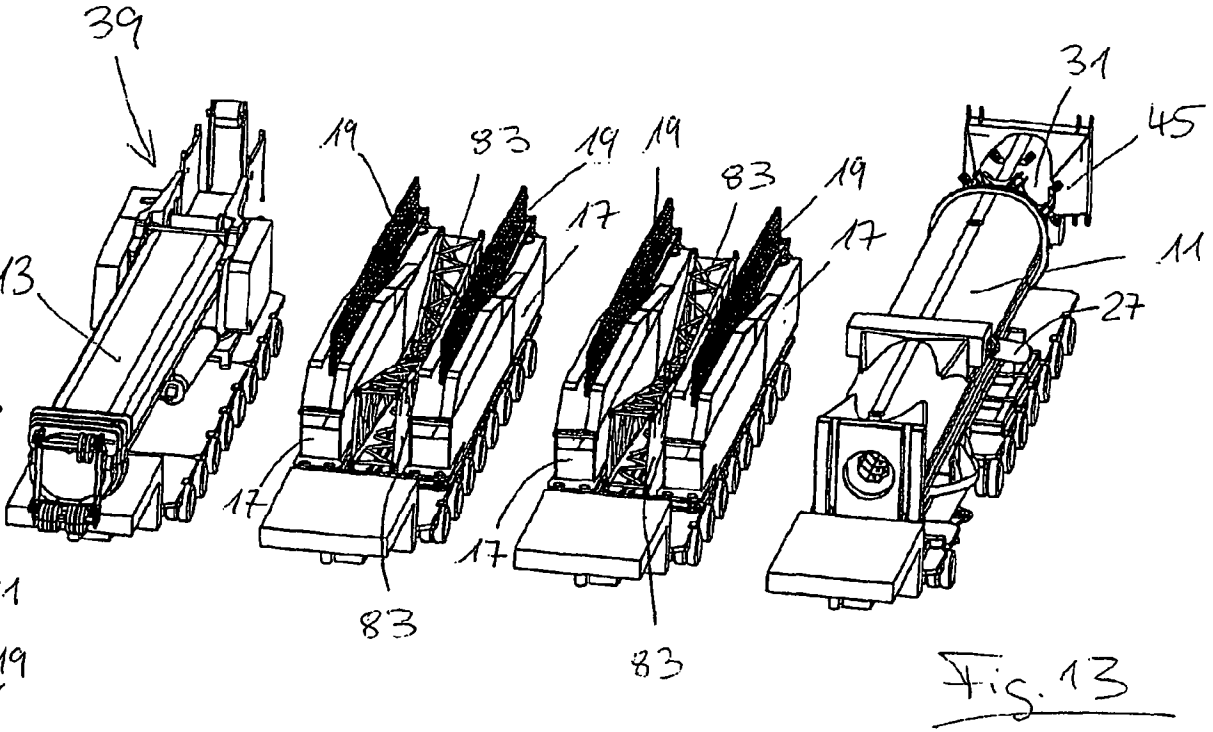
FIG. 13 depicts the manner in which the crane of FIGS. 10-12 can be transported over roads.
Figure 12:
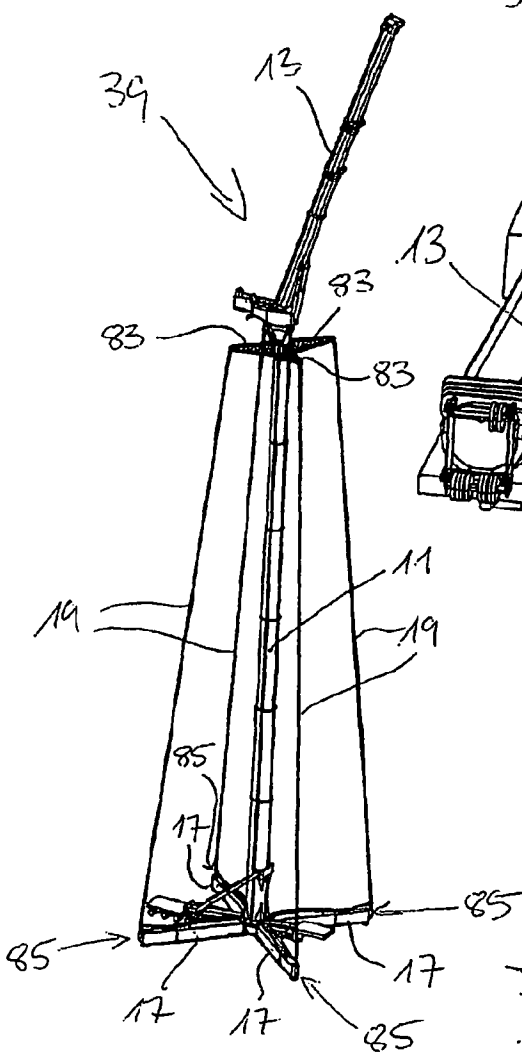
FIG. 12 depicts the crane of FIGS. 10-11 in a generally fully erected state.

FIG. 13 illustrates one possible transport configuration for the vehicle mounted crane proposed by the invention for the embodiment of FIGS. 10-13. Only four transport units are needed, one of which transports the top carriage 39, one the tower 11 and two others each transport two base stabilisers 17, including the co-operating anchoring rods 19 and lattice jib 83.

The invention therefore provides a vehicle mounted crane which has a low overall weight relative to its carrying force and lifting capacity, which requires a small amount of space, and is relatively quick and simple to transport on the roads and make ready for operation at the site. This results in an enormous reduction in the cost of using a crane.

In terms of its design, and in particular the dimensions and weight of its constituent parts, the vehicle mounted crane of the invention can be scaled to suit any requirements. The vehicle mounted crane of the invention is preferably designed so that it is suitable for erecting wind turbines. Currently existing wind turbines have a hub height of approximately 85-100 m and for which the loads to be lifted are up to approximately 52 t. The tower 11 of one possible example of the invention suitable for such jobs has a weight of approximately 60 t and a length of approximately 70 m in its extended state, whilst the weight of the top carriage 39 is approximately 60 t and its jib 13 has a length of approximately 60 m in the extended state. The stabilising width of the star-shaped stabiliser system 17, i.e. the length of the base stabilisers in the extracted state, is approximately 18 m in each case.

Future wind turbines based on already existing plans will have a hub height of approximately 145 m and will require loads in the order of 240 t to be lifted. Such wind turbines can be erected using a vehicle mounted crane according to the invention scaled accordingly without any problem. If necessary, the variant incorporating the counter-jib 37 described in connection with FIG. 8 or 9 may be used.

The invention claimed is:

1. A vehicle mounted crane comprising a super-structure including a top-slewing system, said system comprising a vertical tower and a jib mounted on the tower comprising a first adjusting mechanism connected to the tower at a distance from the bottom end of the tower, said first adjusting mechanism serving to raise the tower from an essentially horizontal transport position into an inclined position, and a second adjusting mechanism acting upon the tower in the region of the bottom end of the tower to shift the bottom end of the tower from a first location in relation to the vehicle when said tower is in the inclined position to a second location in relation to the vehicle to raise the tower from the inclined position into the vertical working position, the crane further including means for guiding the shifting movement of the lower end of the tower from the first location to the second location as it is raised.

2. A vehicle mounted crane as in claim 1, further comprising a pot-shaped or cup-shaped tower mount for receiving the bottom end of the tower when said tower is in the vertical working position, said tower mount forming part of a transport unit for transport of the tower.

3. A vehicle mounted crane as in claim 1, wherein the tower can be erected with the jib fitted thereto.

4. A vehicle mounted crane as in claim 1, further comprising a retaining mechanism in the form of a rigid arm connected to the jib, said retaining mechanism holding the jib in a generally horizontal position during erection of the crane irrespective of the tower inclination.

5. A vehicle mounted crane as in claim 1,
wherein
the tower is disposed on a bogie in the form of a flat-bed transport vehicle for the crane.

6. A vehicle crane as in claim 1, the vehicle comprising a transport unit for transport of the tower, the transport unit including a tower mount for the bottom end of the tower, wherein said second adjusting mechanism acts upon the bottom end of the tower to raise the tower from the inclined position into the vertical working position and to guide the lower end of the tower into said tower mount as said tower is raised.

7. A vehicle crane as in claim 6, wherein
said tower mount is pot-shaped or cup-shaped.

8. A vehicle crane as in claim 1, wherein said second adjusting mechanism shifts the bottom end of the tower linearly between said first and second locations.

9. A vehicle mounted crane as in claim 1,
further comprising
a retaining mechanism in the form of a rigid arm connected to the jib, said retaining mechanism holding the jib in a substantially constant orientation during erection of the crane irrespective of the tower inclination.

10. A vehicle mounted crane as in claim 1, further comprising a mount associated with the vehicle for mounting said tower to the vehicle, wherein the bottom end of said tower is disconnected from said mount when the tower is in the transport position, and the bottom end of said tower is secured to the vehicle by said mount when said tower is in the vertical working position.

11. A vehicle mounted crane as in claim 10, wherein said mount comprises a cup-shaped or pot-shaped mount for receiving the bottom end of said tower in the vertical working position.

12. A vehicle mounted crane comprising
a super-structure including a top-slewing system, said system comprising a vertical tower and a slewing jib mounted on the tower,
a first lifting mechanism connected to the tower at a location spaced from the bottom end of the tower, said first lifting mechanism serving to raise the tower from an essentially horizontal transport position into an inclined position, and
a second lifting mechanism acting upon the tower in the region of the bottom end of the tower to shift the bottom end of the tower from a first location in relation to the vehicle when the tower is in the inclined position to a second location in relation to the vehicle to raise the tower from the inclined position into the vertical working position,
the crane further including means for guiding the shifting movement of the lower end of the tower from the first location to the second location as it is raised, and
a mount at said second location on the vehicle for receiving and securing the bottom end of said tower to the vehicle.

13. A vehicle mounted crane as in claim 12, further comprising a connecting element connected to the jib, said connecting element holding the jib in a substantially constant orientation during erection of the crane irrespective of the tower inclination.

14. A vehicle mounted crane as in claim 13, wherein said connecting element holds the jib in a substantially horizontal orientation during erection of the crane irrespective of the tower inclination.

15. A vehicle crane as in claim 12, the vehicle comprising a transport unit for transport of at least said tower, wherein said mount comprises a tower mount on said vehicle for the bottom end of the tower, wherein said second lifting mechanism acts upon the bottom end of the tower to raise the tower from the inclined position into the vertical working position and to guide the lower end of the tower into said tower mount as said tower is raised.

16. A vehicle crane as in claim 15, wherein
said tower mount is pot-shaped or cup-shaped.

17. A vehicle crane as in claim 12, wherein said second lifting mechanism shifts the bottom end of the tower linearly between said first and second locations.

* * * * *